US005519905A

United States Patent [19]

Bernstein et al.

[11] Patent Number: 5,519,905

[45] Date of Patent: May 28, 1996

[54] BED SIDE RAILS

[75] Inventors: Michael S. Bernstein, Natick, Mass.; David W. Crossley, Woonsocket, R.I.; Randy L. Abrams, Leominster, Mass.; Jerry E. Johnson, Grand Junction, Tenn.

[73] Assignee: Safety 1st, Inc., Chestnut Hill, Mass.

[21] Appl. No.: 421,897

[22] Filed: Apr. 14, 1995

Related U.S. Application Data

[63] Continuation of Ser. No. 187,846, Jan. 28, 1994, Pat. No. 5,437,067.

[51] Int. Cl.[6] ..... A47C 21/08

[52] U.S. Cl. ..... 5/426; 5/658; 5/905

[58] Field of Search ..... 5/425, 426, 658, 5/905; 362/157, 130

[56] References Cited

U.S. PATENT DOCUMENTS

| | | |
|---|---|---|
| 1,135,523 | 4/1915 | Henderson . |
| 1,739,337 | 12/1929 | VonCanon et al. . |
| 2,608,696 | 9/1952 | Le Roy . |
| 2,763,014 | 9/1956 | Luger . |
| 3,179,957 | 4/1965 | Norton . |
| 3,402,409 | 9/1968 | Kain . |
| 3,482,810 | 12/1969 | Bailey . |
| 3,747,133 | 7/1973 | Hutt . |
| 3,971,083 | 7/1976 | Peterson . |
| 4,084,277 | 4/1978 | Conrad et al. . |
| 4,103,376 | 8/1978 | Benoit et al. . |
| 4,178,645 | 12/1979 | Cosme . |
| 4,214,327 | 7/1980 | Smith . |
| 4,431,154 | 2/1984 | Hamm . |
| 4,483,028 | 11/1984 | Payne . |
| 4,484,367 | 11/1984 | Jenkins . |
| 4,672,703 | 5/1987 | Frazier . |
| 4,724,559 | 2/1988 | Bly . |
| 4,747,171 | 5/1988 | Enisele et al. . |
| 4,783,864 | 11/1988 | Turner . |
| 4,833,743 | 5/1989 | Howell et al. . |
| 5,038,430 | 8/1991 | Bly . |
| 5,044,025 | 9/1991 | Honsinger et al. . |
| 5,148,356 | 9/1992 | Freese et al. . |
| 5,175,897 | 1/1993 | Marra, Jr. . |
| 5,191,663 | 3/1993 | Holder et al. . |
| 5,365,623 | 11/1994 | Springer . |

FOREIGN PATENT DOCUMENTS

| | | |
|---|---|---|
| 2200541A | 8/1988 | United Kingdom . |

*Primary Examiner*—Michael J. Milano
*Attorney, Agent, or Firm*—Wolf, Greenfield & Sacks

[57] ABSTRACT

A bed side rail particularly suitable for use by childred has a protective panel which carries a pair of arms that fit under a mattress to support the panel at the edge of a bed. Hinges connect the panel to the arms so that the panel may be moved between an operative position wherein it extends upwardly from the arms above the level of the mattress to an inoperative position wherein it extends downwardly from the arms out of the way. The panel carries a flashlight which may readily be removed from the panel by a small child. The flashlight has an actuator in the grip which turns the flashlight on when the handle is grasped by the child, and the light will remain on for a selected period after the child replaces the flashlight in the pocket of the panel and releases the actuator. The flashlight is retained in the pocket so that it will not fall out when the panel is moved between operative and inoperative positions and yet may be removed from the pocket by the child when desired.

21 Claims, 5 Drawing Sheets

BED SIDE RAILS

This application is a continuation application Ser. No. 08/187,846 filed Jan. 28, 1994 now U.S. Pat. No. 5,437,067.

This invention relates to bed rails particularly used for toddlers when they move from a crib to a bed. A variety of such products are presently on the market, and they employ a variety of different arrangements that enable the bed rail to be moved from an operative to an inoperative position. The present invention is an improvement upon those bed rails now available in that it employs a new hinge system for raising and lowering the bed rail and includes a flashlight built into the bed rail so that it is readily accessible to the child.

In accordance with the present invention, the flashlight is conveniently mounted on the bed rail within easy reach of a child sleeping in the bed with which a bed rail is being used, and the flashlight has a grip which facilitates removal of the flashlight from a pocket in the bed rail which holds it. The configuration of the flashlight is such that when it is grasped by the child, the light of the flashlight will automatically be turned on and the light will remain on while the child holds the flashlight and for a period after the flashlight is returned to the pocket which will allow the child to fall asleep with a soft glow from the light.

The bed rail also includes a pair of support arms that fit under the mattress to hold the bed rail in place. Rugged and easy to operate hinges connect the support arms to the protective bed rail panel so that it is easy to swing the panel between the raised or operative position and the down or inactive position.

The invention will be better understood and appreciated from the following detailed description of the preferred embodiment thereof.

BRIEF FIGURE DESCRIPTION

DETAILED DESCRIPTION

Figure 1:
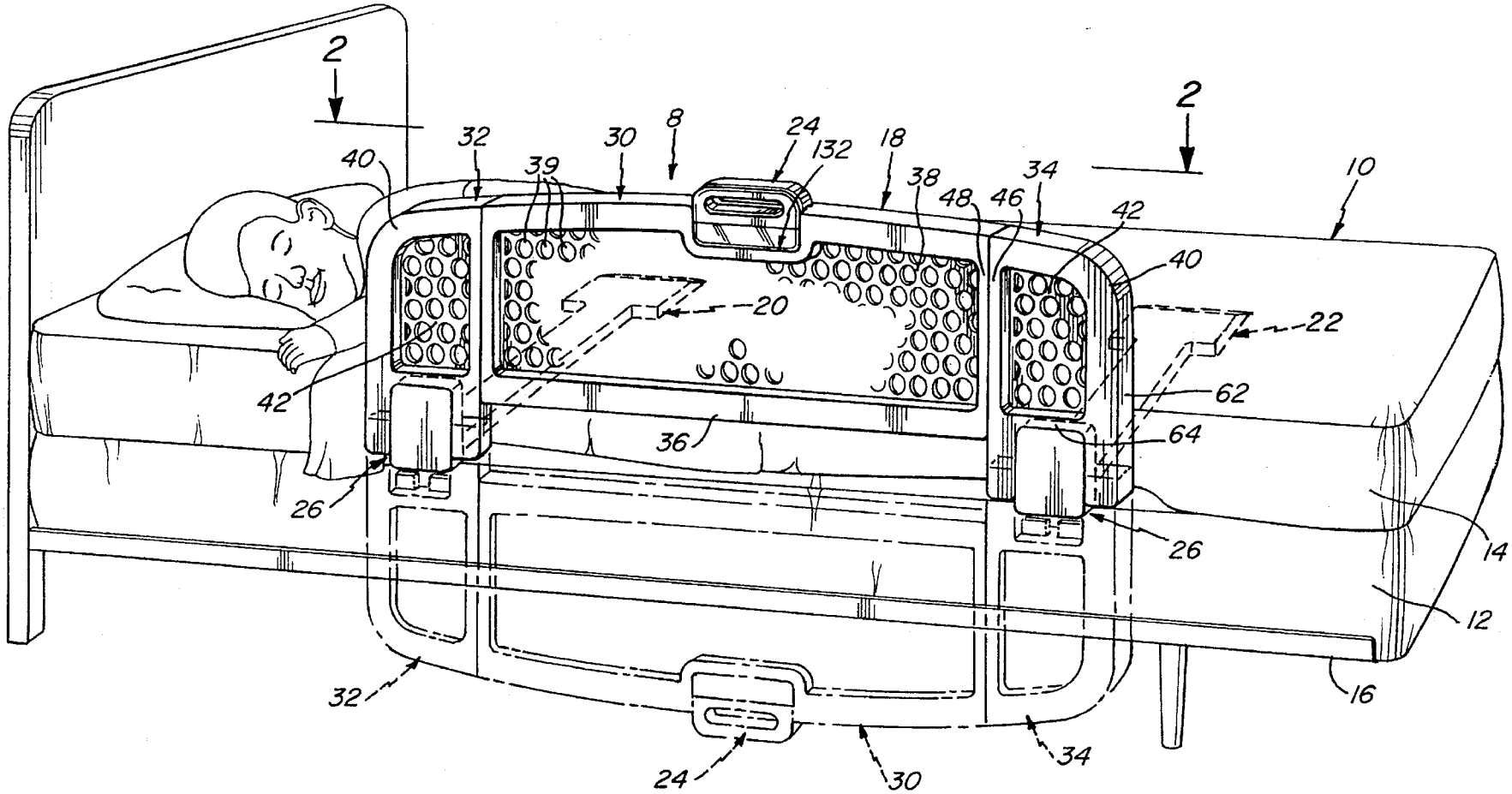
FIG. 1 is a perspective view of the bed side rail of this invention shown attached to a bed and with the operative and inoperative positions of the bed rail shown in full and broken lines, respectively.

In FIG. 1 the bed rail 8 of the present invention is shown attached to a bed 10 having a box spring 12 and mattress 14 resting on a frame 16. A youngster is shown asleep in the bed. The bed rail 8 includes a main panel 18, a pair of support arms 20 and 22 and a flashlight 24. Hinges 26 that are essentially identical to one another connect each of the arms 20 and 22 to the panel 18 and enable the panel to move from the operative or raised position shown in full lines in FIG. 1 to the inoperative or lowered position shown in broken lines in that figure. The bed rail is mounted on the bed simply by sliding the arms 20 and 22 between the box spring 12 and mattress 14, and the bed rail may be removed by sliding the arms out from between the box spring and mattress.

The main panel 18 is shown in FIG. 1 to include three sections, namely a center section 30 and left and right side sections 32 and 34. The center section 30 has a peripheral frame 36 surrounding a screen 38 with a dense array of openings 39, and the side panel sections which are the mirror image of one another each has a frame 40 surrounding a screen 42. The screens 38 and 42 have the same pattern of openings that allow free circulation of air about the child and prevent the child from getting a closed-in feeling. Because the side sections 32 and 34 of the panel 18 together with their corresponding arms 20 and 22 are structurally and functionally essentially identical to one another, only panel section 34 and its corresponding arm 22 will be described in detail, and it should be understood that the description applies equally to the other side panel section 32 and its arm 20.

Figure 5:
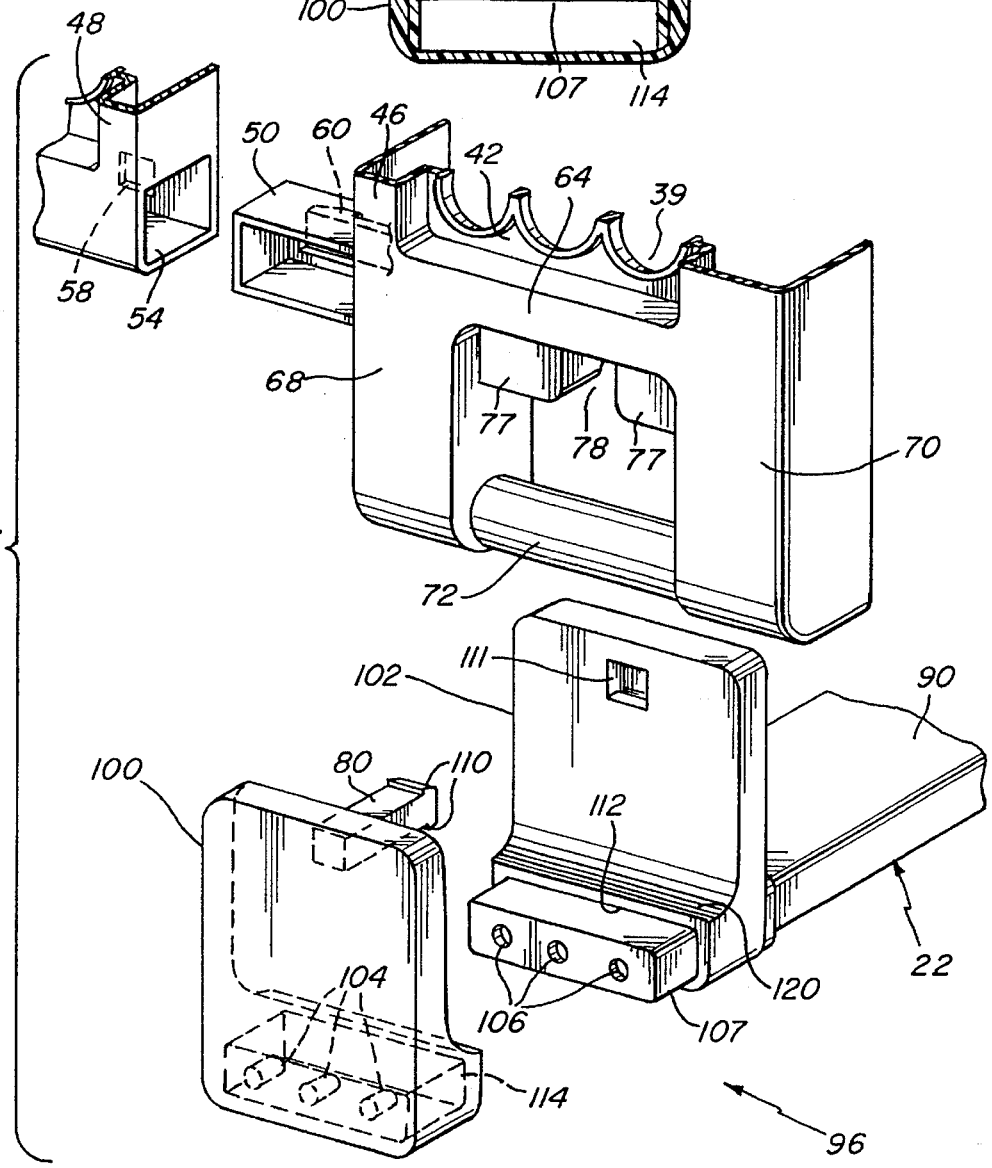
FIG. 5 is a fragmentary exploded view of one of the two hinges that join the arms to the panel of the bed rail and that enable the panel to be pivoted between its operative and inoperative positions.

The frame 40 of side panel 34 has an inner vertical section 46 which engages the adjacent vertical section 48 of the center panel section 30. The two vertical sections 46 and 48 are held together by horizontal posts 50 and 52 that fit into recesses 54 and 56 at the tops and bottoms of the vertical sections of the frames 36 and 40, respectively. As shown in FIG. 5, a hole 58 is provided in the margin of recess 54, which receives a detent 60 carried by the post 50, so that once connected together, the two are not intended to separate. The bed rail may be conveniently packaged with the side panels 32 and 34 detached for more compact packaging and be assembled by the consumer. Once assembled, they would not later be separated.

Figure 4:
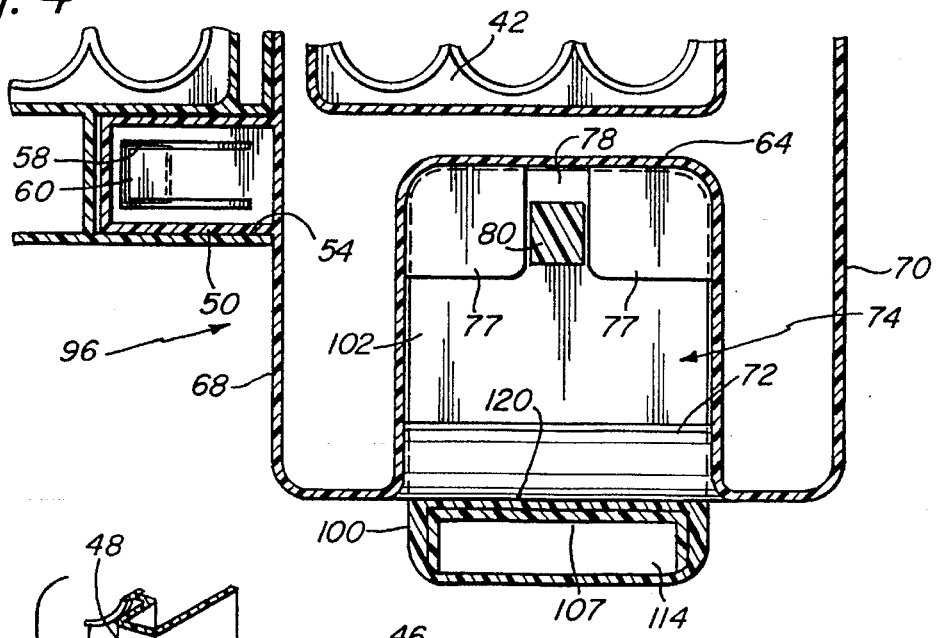
FIG. 4 is a fragmentary cross-sectional view of the bed rail taken along the section line 4—4 in FIG. 3.

Frame 40 of the side panel section 34 also includes an outer vertical section 62 which merges smoothly into the top rail of the side panel 34. The two vertical sections 46 and 62 of the frame 40 extend downwardly below the bottom section 64 of the frame 40 and form a pair of parallel legs 68 and 70 that comprise a portion of the hinge 26 that joins the panel 40 to its arm 22. As best shown in FIG. 5, the lower ends of the two legs 68 and 70 are joined by a horizontal hinge pin 72 that extends across the hinge slot 74 in the arm 22, which is described in detail below. As shown in FIGS. 4 and 5, a pair of blocks 77 depend from the section 64 and are separated by a slot 78 that receives a horizontal pin 80 carried by the hinge portion 96 of the arm 22.

Figure 2:
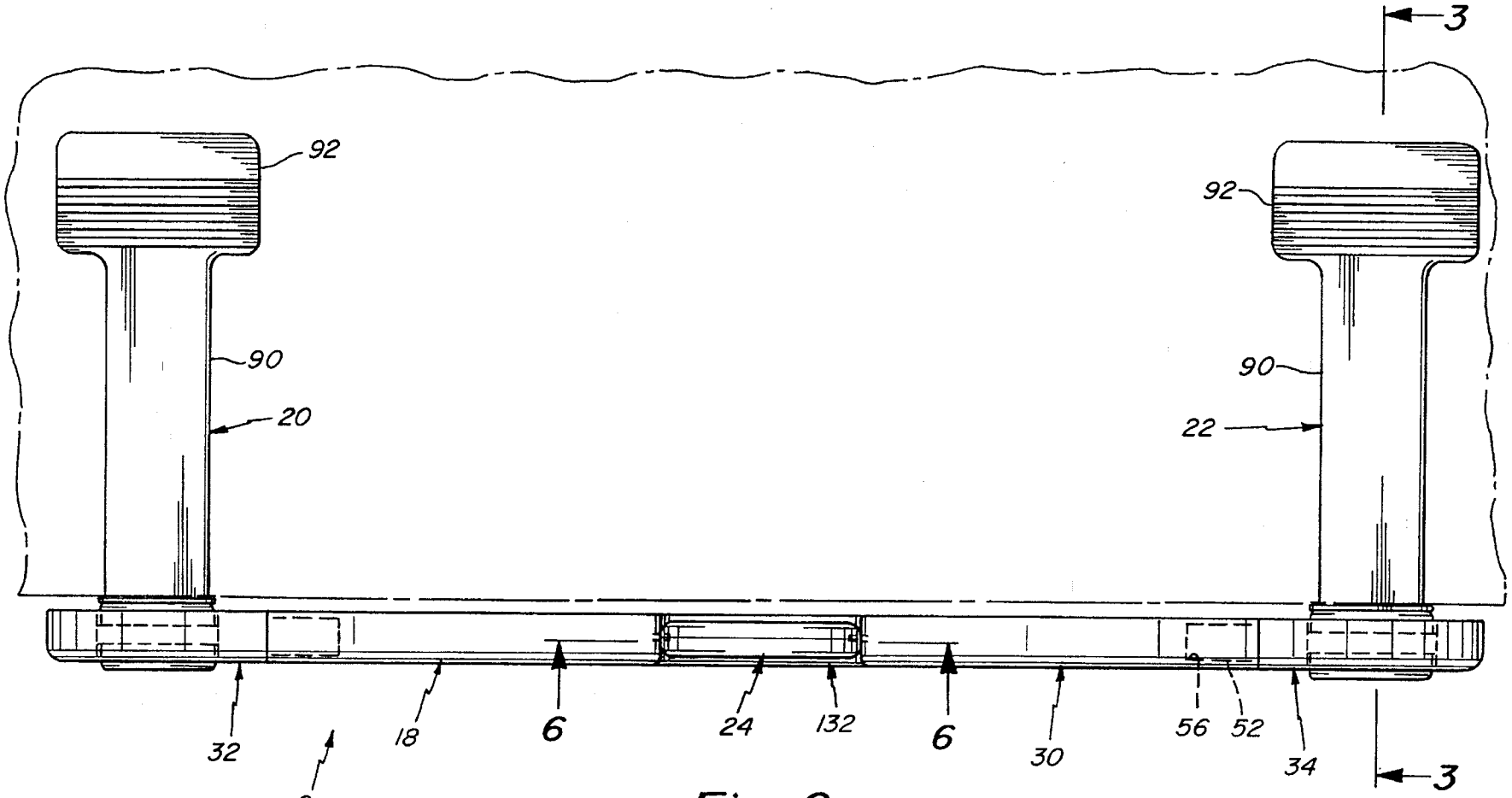
FIG. 2 is a plan view of the bed rail taken along the sight line 2—2 in FIG. 1.

The arm 22 includes an elongated horizontal segment 90, a friction plate 92, and the hinge portion 96 that contains the slot 74 that receives the lower end of the side panel section 34 and particularly the hinge pin 72 and the blocks 77. The friction plate 92 (see FIGS. 1 and 2) is substantially wider than the segment 90 of the arm and is serrated on its upper surface to resist the arm being accidentally pulled out from between the box spring 12 and mattress 14. The segment 90 of the arm and the plate 92 are molded as a unitary structure while the hinge portion 96 is separately molded and thereafter attached to the segment 90. Hinge portion 96 includes a pair of parallel plates 100 and 102 that are secured together by a plurality of pins and holes 104 and 106 respectively disposed on the lower ends of the plate 100 and the adjacent end 107 of arm segment 90, and by the pin 80 that has barbs 110 on its free end. The pin with its barbs spas into a slot 111 in plate 102. The plate 102 also has a slot 112 in its lower end that receives the end 107 of the arm segment 90. The end 107 of the arm 22 terminates in a pocket 114 in the lower end of plate 100. The pins 104 are located in the pocket 114 as is evident in FIGS. 3, 3A and 5.

Figures 3, 3A:
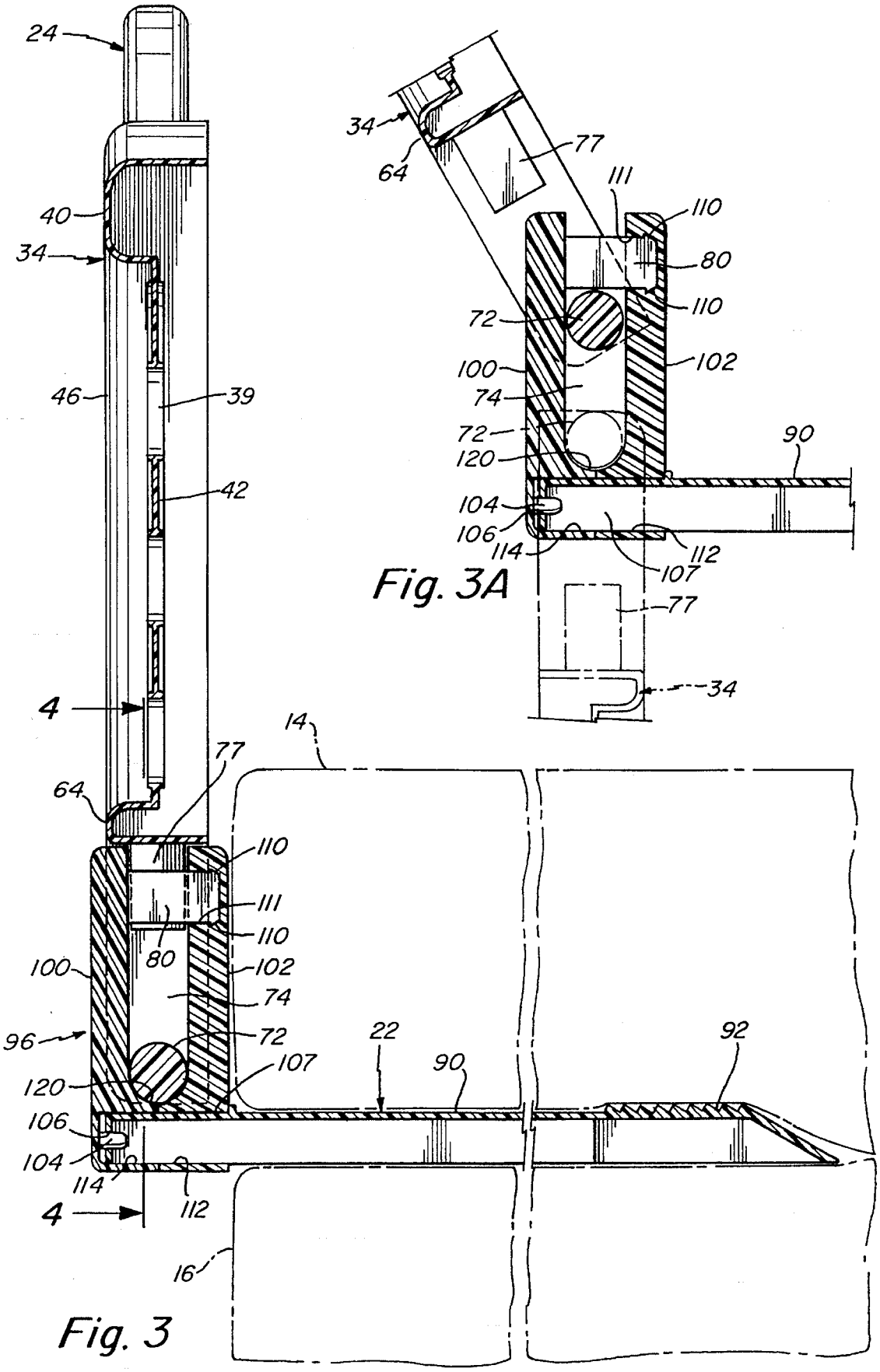
FIG. 3 is a cross-sectional view of the bed rail taken along the section line 3—3 in FIG. 2.
FIG. 3A is a fragmentary view of the hinge area of the bed rail and suggesting in broken lines the manner in which the bed rail is moved to the inoperative position.

When the hinge portions 96 of arms 20 and 22 are assembled in the manner described and shown in FIGS. 3–5, the hinge pins 72 extend through the slots 74 defined by the plates 100 and 102, and the legs 68 and 70 of the side panel frames 40 are disposed just beyond the ends of the slots adjacent the outer sides of the plates 100 and 102. If the pins 72 are disposed at the bottom of the slots 74 and rest on the seats 120 and the panel 18 is in the raised or operative position shown in FIGS. 1 and 3, the blocks 77 also lie in slots 74 on either side of the pin 80 and the panel 18 is in the upright position. In order to lower the panel 18 to its inoperative position shown in broken lines in FIG. 1, the panel 18 is first raised as shown in broken lines in FIG. 3A so as to free the blocks 77 from the slot 74, and thereafter the panel may be swung downwardly while remaining attached to the arms 20 and 22 because the hinge pins 72 are retained in the slots 74 by virtue of the pin 80 which close the tops of the slots. Thus the panel will be supported on the arms even in the lowered position. To again place the panel in the raised or operative position, the user simply swings the panel upwardly about the hinges 26, pulls it upwardly so that the blocks 77 are aligned with and disposed above the slots 74 and then lowers the panel so that the blocks 77 enter the slots.

Figure 6:
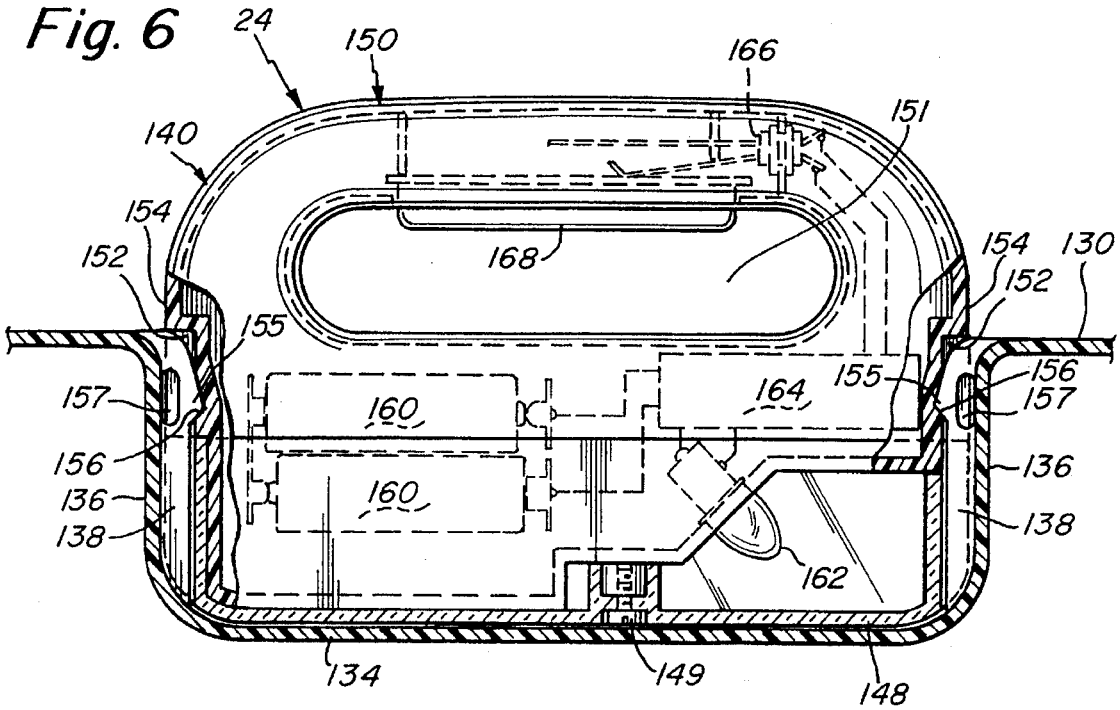
FIG. 6 is a fragmentary view, partially in section, of the flashlight showing the manner in which the flashlight is held in its pocket in the panel.
Figure 7:
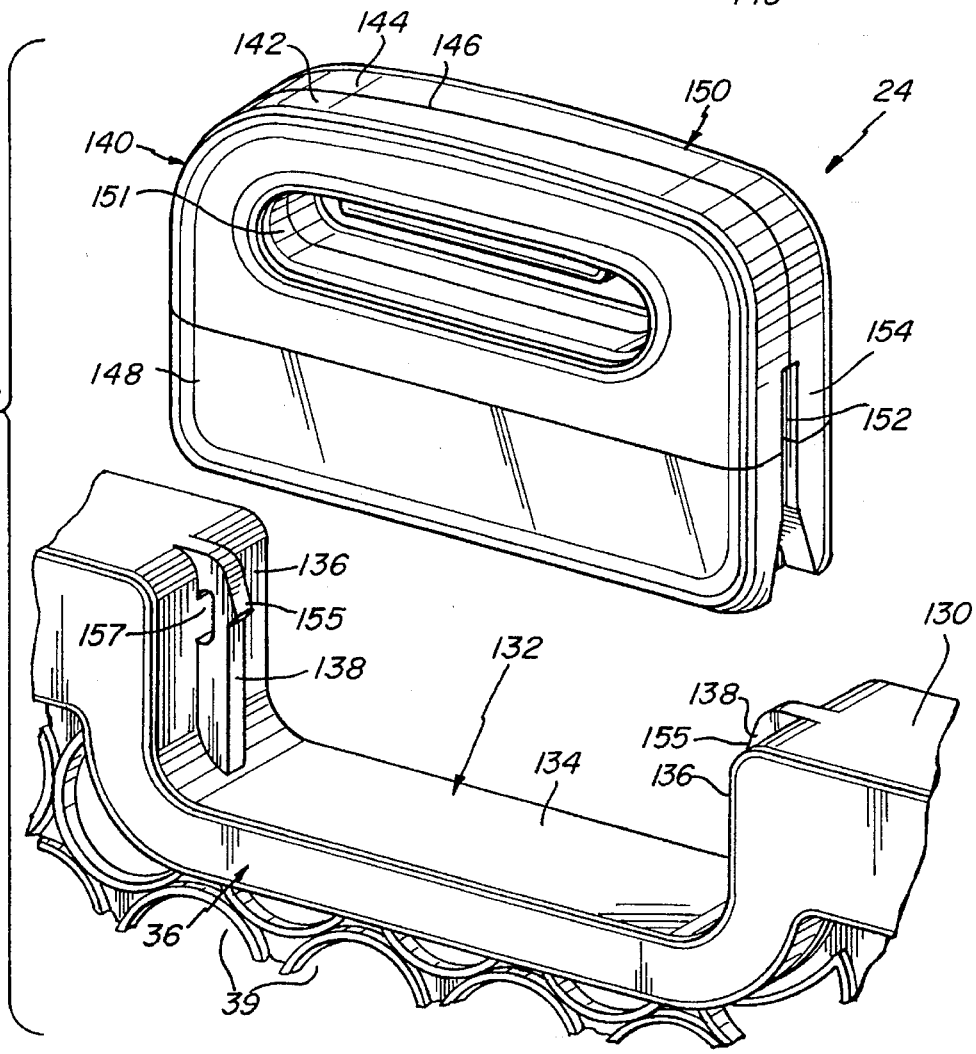
FIG. 7 is an exploded view of the flashlight and pocket with the flashlight removed from the pocket.

In FIGS. 6 and 7 another feature of the present invention is shown, namely the flashlight 24 built into and removable from the frame 36 and more specifically the upper rail of the center panel section 30. The upper bowed rail 130 of the frame 36 has a U-shaped pocket 132 defined by bottom wall 134 and side walls 136. The pocket 132 is open at the top, and ribs 138 carried on the side walls 136 serve to position the flashlight 24 in the pocket as described below.

The flashlight 24 has a clamshell-type housing 140 composed of two halves 142 and 144 that join one another along seam 146. Housing 140 also includes a transparent lens 148. The lens 148 fits over the bottom of the two halves of the housing and retains the housing in assembled relationship. A screw post 149 on the bottom of the lens retains it in place and allows the lens to be conveniently removed to change the batteries 160 or lamp 162. A handle 150 is formed in the housing by an opening 151 that extends through the housing so as to enable a small child to grip the flashlight and lift it out of the pocket 132. As seen in FIGS. 6 and 7, slots 152 are provided in the end walls 154 of housing 140 for receiving the ribs 138 in the pocket to properly position the flashlight in it. A retaining device in the form of projections 155 in the ribs 138 and recesses 156 in the bottoms of the slots on each side of the pocket and flashlight releasably retain the flashlight 24 in the pocket 132 even when the panel 18 is inverted to its inactive position. Some flexibility is afforded the projections by the cut-outs 157 in the ribs as shown in FIGS. 6 and 7.

In FIG. 6, the flashlight housing 140 is shown to include batteries 160, lamp 162 and a time delay relay 164 below the handle 150 and opening 151. The handle 150 contains a switch 166 that is operated by an actuator bar 168 that extends from the handle 150 into the opening 151. The actuator bar 168 is positioned on the handle so that when a child grasps the handle, the actuator will immediately close the switch. The switch 166 is disposed in the flashlight circuit containing the batteries, lamp and time delay relay so that closing the switch will cause the lamp 162 to light. The light will remain on for a selected period of perhaps five minutes after the actuator 168 is released such as when the flashlight is returned to the pocket 132 in the panel 18. Thus if the child gets up during the night to go to the bathroom and then returns to the bed and replaces the flashlight 24 in the pocket 132, the light will remain on for a short period while the child falls asleep.

Having described the bed side rail of this invention in detail the reader will readily appreciate its many advantages. The unit may very quickly and easily be mounted on a child's bed simply by sliding the arms 20 and 22 under the mattress until the panel 18 engages the side of the mattress. The panel may be placed in operative position by turning it upright and lowering it so that the blocks 77 engage the slots 74 in the hinge portions 96 of the arms. Just as easily the panel 18 may be lowered out of the way by raising it and then swinging it downwardly to the inactive position. When in bed, the child enjoys the security of knowing that without leaving the bed he or she has a light available that can be taken wherever the child goes, and that when the child returns to bed he or she can place the flashlight 24 in the pocket 132 and the light will remain on for a period that will allow the child to fall asleep.

The bed side rail of this invention is relatively inexpensive to manufacture, lightweight and readily transportable as it can be folded into a flat condition by swinging the panel 18 clockwise as viewed in FIG. 3 so that it lies immediately over and parallel to the arms 20 and 22.

In light of the foregoing description, it will be appreciated that numerous modifications may be made of this invention without departing from its spirit. Therefore, it is not intended that the breadth of the invention be limited to the single embodiment illustrated and described. Rather, the scope of the invention is to be determined by the appended claims and their equivalents.

We claim:

1. A bed side rail comprising a panel having a lower portion and left and right ends, a pair of arms pivotally connected to the lower portion of the panel, one adjacent each end, said arms intended to lie beneath a mattress in a horizontal plane and support the panel in a vertical plane selectively either above or below the arms, a pocket in the panel and a flashlight removably mounted in the pocket, and a latch interconnecting the pocket and flashlight for retaining the flashlight in the pocket.

2. A bed side rail as defined in claim 1 wherein the flashlight includes a circuit having a power source and lamp, said circuit also including a switch for closing the circuit and a time delay relay for opening the circuit so that the lamp may be lighted manually and will thereafter turn off automatically.

3. A bed side rail as defined in claim 2 wherein the flashlight has a hand grip, and an actuator is mounted on the hand grip for closing the switch when the hand grip is engaged.

4. A bed side rail as defined in claim 2 wherein the latch is of a snap fit type enabling a child to overcome the snap fit and remove the flashlight from the pocket by pulling it out of the pocket.

5. A bed side rail as defined in claim 2 wherein the time delay relay turns off the light a predetermined time after the actuator is released.

6. A bed side rail comprising a panel and a support for the panel for releasable attachment to a bed, a holder in the side rail for receiving a flashlight, a light removably mounted in the holder, and a latch for releasably retaining the light in the holder.

7. A bed side rail as defined in claim 6 wherein the holder is in the panel.

8. A bed side rail as defined in claim 6 wherein the light is a flashlight.

9. A bed side rail as defined in claim 6 wherein the latch releasably retains the light in the holder regardless of the orientation of the panel.

10. A bed side rail as defined in claim 8 wherein the support is pivotally connected to the panel enabling the panel to swing from an operative position wherein it extends upwardly in a vertical plane from the support, to an inoperative position wherein the panel extends downwardly in a vertical plane from the support.

11. A bed side rail as defined in claim 10 wherein the support includes arms attached to the panel and which are intended to be inserted beneath a mattress of the bed.

12. A bed side rail as defined in claim 8 wherein the flashlight includes a circuit having a power source and lamp, said circuit also including a switch for closing the circuit and a time delay relay for opening the circuit so that the lamp may be lighted manually and will thereafter turn off automatically.

13. A bed side rail as defined in claim 12 wherein the flashlight has a hand grip, and an actuator is mounted on the hand grip for closing the switch when the hand grip is engaged.

14. A bed side rail as defined in claim 13 wherein the time delay relay turns off the light a predetermined time after the actuator is released.

15. A bed side rail as defined in claim 10 wherein the pivotal connection between the panel and support enables the support to be moved to a position parallel to and adjacent the panel so that the side rail may be easily transported.

16. A bed side rail as defined in claim 11 wherein the pivotal connection between the panel and support enables the support to be moved to a position parallel to and adjacent the panel so that the side rail may be easily transported.

17. A bed side rail as defined in claim 6 wherein the support is shaped to fit under a mattress and to be held in place by it to in turn hold the panel at one side of the mattress.

18. A bed side rail as defined in claim 6 wherein the support comprises arms connected to the lower portion of the panel for placement under a mattress.

19. A bed side rail as defined in claim 8 wherein the panel includes a frame having a top rail and the holder is disposed in the top rail, and wherein the flashlight extends above the rail on when mounted in the holder.

20. A bed side rail as defined in claim 19 wherein the flashlight has a handgrip, and an actuator is mounted on the handgrip for turning the flashlight on when the grip is engaged.

21. A bed side rail as defined in claim 20 wherein the flashlight has a circuit including a time delay relay for opening the circuit so that the flashlight may be turned On manually by the actuator and will thereafter turn off automatically.

* * * * *